US008841842B2

(12) United States Patent
Matsumoto

(10) Patent No.: US 8,841,842 B2
(45) Date of Patent: Sep. 23, 2014

(54) LIGHT SOURCE DEVICE

(71) Applicant: Stanley Electric Co., Ltd., Tokyo (JP)

(72) Inventor: Takahiro Matsumoto, Yokohama (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 14/033,303

(22) Filed: Sep. 20, 2013

(65) Prior Publication Data

US 2014/0084786 A1 Mar. 27, 2014

(30) Foreign Application Priority Data

Sep. 21, 2012 (JP) ..... 2012-208745

(51) Int. Cl.
*H01K 1/04* (2006.01)
*H01K 1/08* (2006.01)

(52) U.S. Cl.
CPC ... *H01K 1/04* (2013.01); *H01K 1/08* (2013.01)
USPC ..... 313/578; 313/577

(58) Field of Classification Search
USPC ..... 313/578, 579
See application file for complete search history.

(56) References Cited

U.S. PATENT DOCUMENTS 1,815,779 A * 7/1931 Koref et al. ..... 313/344
2,892,740 A * 6/1959 Coomes et al. ..... 313/341
4,864,186 A * 9/1989 Milewski et al. ..... 313/341
5,072,147 A * 12/1991 Pugh et al. ..... 313/341
6,489,723 B2 12/2002 Miyanaga

FOREIGN PATENT DOCUMENTS

DE 10 2005 062 392 A1 1/2007
JP 63-168963 A 7/1988
JP 2001-319617 A 11/2001

OTHER PUBLICATIONS

Extended European Search Report (EESR) dated Jan. 2, 2014 (in English) in counterpart European Application No. 13020103.1.
Von R. Fries; "New Lamps for General Lighting Purposes"; Bulletin de L'Association Suisse Des Electriciens Switzerland; vol. 25; Nov. 9, 1934; pp. 623-626.
David R. Lide; "Electrical Resistivity of Pure Metals"; CRC Handbook of Chemistry and Physics, XP002545308; Sep. 10, 2009; pp. 12-39-12-40.

* cited by examiner

*Primary Examiner* — Mary Ellen Bowman
(74) *Attorney, Agent, or Firm* — Holtz Holtz Goodman & Chick PC

(57) ABSTRACT

A filament of simple structure showing improved conversion efficiency is provided. There is provided a light source device comprising a light-transmitting gas-tight container, a filament disposed in the light-transmitting gas-tight container, and a lead wire for supplying an electric current to the filament, wherein the filament consists of a single crystal. Sum of concentration of lattice defects and impurity concentration of the filament consisting of a single crystal is preferably lower than 0.01%.

9 Claims, 6 Drawing Sheets

W CRYSTAL, ωp=0.8 eV, T= 3000 K, ρ=1% (0.01)

W CRYSTAL, ωp=0.8 eV, T= 3000 K, ρ=0.1% (0.001)

W CRYSTAL, ωp=0.8 eV, T= 3000 K, ρ=0.01% (0.0001)

LIGHT SOURCE DEVICE

TECHNICAL FIELD

The present invention relates to a light source device utilizing a filament showing high visible light conversion efficiency.

BACKGROUND ART

There are widely used incandescent light bulbs which produce light with a filament such as tungsten filament heated by an electric current flown through it. However, although incandescent light bulbs show high electric power-to-light conversion efficiency (80% or higher), much of the light thereby produced consists of infrared radiation components as shown in FIG. 6 (90% or more in the case of 3000K shown in FIG. 6), and therefore the electric power-to-visible light conversion efficiency thereof is low. Specifically, visible light conversion efficiency of incandescent light bulbs is as low as about 15 lm/W (visible light conversion efficiency of fluorescent lamps is 90 lm/W). In addition, although incandescent light bulbs show a radiation spectrum close to sunlight providing superior color rendering properties, they have a problem that they impose large environmental loads.

Moreover, it is well known that if grain size of metallic materials including tungsten becomes large due to recrystallization, strength and ductility thereof decrease. Specifically, recrystallized grains of pure tungsten have an equi-axed crystal structure and a relatively round shape, and contain many grain boundaries perpendicular to a line axis. Therefore, if a filament coil made of pure tungsten is used at a high temperature, slippage occurs at crystal grain boundaries extending along the radial direction of the filament, and the filament is easily deformed with a small external force such as own weight (creep deformation). Therefore, the filament comes to be easily locally heated, and easily cause disconnection.

In order to obtain small crystal grains (grain boundary strengthening), tungsten metals added with various elements and compounds (doped tungsten) are practically used. For example, Patent document 1 proposes a filament using tungsten added with thoria ($ThO_2$) or tungsten added with Re. In addition, tungsten added with $La_2O_3$, $CeO_2$, or potassium (K) for the grain boundary strengthening is marketed. In doped tungsten added with a trace amount of thoria or potassium (K), growth of crystal grains along the radial direction of the filament is suppressed, and therefore recrystallized grains thereof are long and large crystals extending along the processing direction (filament axis direction). Thoria dispersedly exists at crystal boundaries of tungsten to prevent migration of the grain boundaries, and thereby suppresses growth of grains to provide small recrystallized grains. Potassium (K) suppresses growth of grain boundaries along the radial direction of the filament to provide long and large crystals extending along the processing direction.

Further, Patent document 2 proposes use of tungsten having a purity of 4N (99.99% or higher) for an anode and use of tungsten added with K as a cathode in a high pressure mercury lamp for preventing impurities contained in tungsten from evaporating and adhering to internal wall of an arc tube to cause blackening.

PRIOR ART REFERENCES

Patent Documents

Patent document 1: Japanese Patent Unexamined Publication (KOKAI) No. 63-168963

Patent document 2: Japanese Patent Unexamined Publication (KOKAI) No. 2001-319617

SUMMARY OF THE INVENTION

Object to be Achieved by the Invention

As described above, in tungsten used in the conventional filaments, crystal boundaries are made smaller by doping with impurities in order to improve the strength and ductility thereof. Further, Patent document 2 proposes to reduce impurities contained in tungsten for preventing impurities from evaporating and adhering to internal wall of an arc tube, but does not describe influence of crystal boundaries and crystallinity of filament on the electric power-to-visible light conversion efficiency at all.

An object of the present invention is to provide a filament showing high electric power-to-visible light conversion efficiency and high strength at high temperature.

Means for Achieving the Object

In order to achieve the aforementioned object, a single crystal is used as a filament of a light source device in the present invention.

Effect of the Invention

According to the present invention, a single crystal filament containing no grain boundary or almost no grain boundary is used, and therefore it is hardly deformed, and shows high strength, even when it is heated to a high temperature. Further, since it does not contain lattice defects such as grain boundary, it can reduce electron scattering, thereby improve reflectance (reduce emissivity) for the long wavelength region, and increase radiation efficiency for the visible region.

MODES FOR CARRYING OUT THE INVENTION

Figure 1:
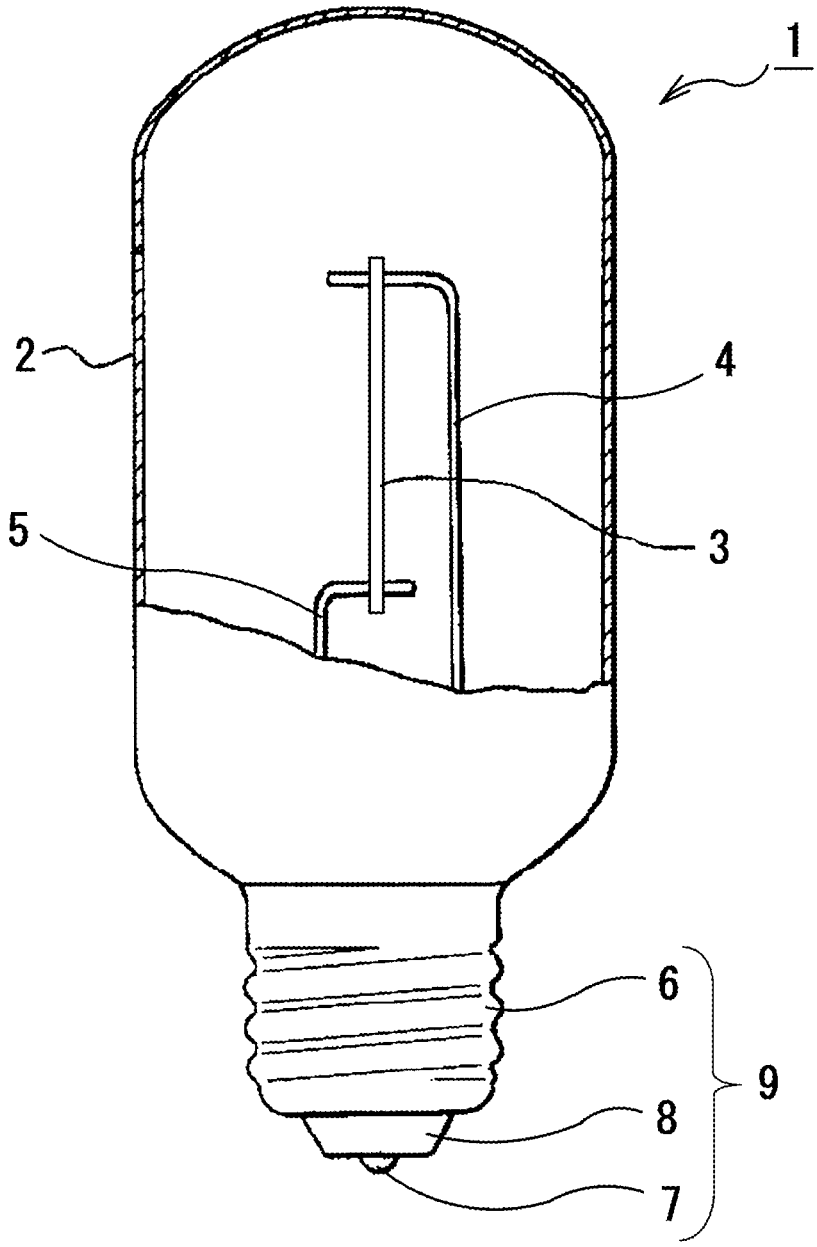
FIG. 1 shows a cut-out sectional view of an exemplary incandescent light bulb.

In the present invention, a single crystal is used for a filament of a light source device. Since a single crystal filament contains no grain boundary or almost no grain boundary unlike a polycrystal filament, it does not cause slippage at crystal boundaries like a polycrystal filament. Therefore, it does not cause creep deformation due to an external force such as own weight even when it is heated to a high temperature, and it does not easily cause local temperature elevation and disconnection.

Although the single crystal filament referred to in the present invention preferably contains no grain boundary, it may contain grain boundaries at such a low level that it can be considered to contain substantially no grain boundary compared with a polycrystal. For example, it may contain several grain boundaries. However, even when the single crystal filament contains a few grain boundaries, it is desirable that axial orientations of the crystals divided by these grain boundaries are the same. Whether such a characteristic is satisfied can be determined on the basis of electric specific resistance of metal. For example, in the case of tungsten, a polycrystal filament shows a specific resistance of about 6 μΩ·cm at room temperature of 300K, but the specific resistance can be made to be 5.5 μΩ·cm or lower by single-crystallizing the filament, and the most favorable crystal in which impurities are extremely restricted shows a specific resistance of 1 μΩ·cm or lower.

Specifically, in the single crystal filament, sum of impurity concentration and concentration of lattice defects such as grain boundary and dislocation is preferably lower than a predetermined value. This predetermined value is, for example, 0.01%. The reason why the concentration of lattice defects is added to the impurity concentration is that, not only impurities, but also lattice defects in the filament cause electron scattering, thereby make linear response relaxation time of electrons shorter, i.e., make electronic response slower, and reduce the reflectance for lights from the visible region to the infrared region (namely, increase emissivity of infrared light). If it is recalled that, for example, silver metal having a high reflectance shows a low electric specific resistance, the relation between the electric specific resistance and the reflectance will be easily understood. Therefore, by making the sum of the concentration of lattice defects and impurity concentration smaller than a predetermined value, the emissivity for longer wavelength (infrared light) can be reduced, and the emissivity for shorter wavelength (visible light) can be increased.

The impurity concentration referred to here means a value obtained by dividing number of impurity atoms per $cm^3$ with number of the base material atoms per $cm^3$ expressed in terms of atomic percentage (atm %). The concentration of lattice defects is a ratio of number of crystal defects such as grain boundary and dislocation to total number of atoms in a certain volume of single crystal expressed in terms of atomic percentage (atm %).

A specific example of the present invention will be explained with reference to the drawings.

FIG. 1 shows a cut-out sectional view of the incandescent light bulb of the example. The incandescent light bulb 1 is constituted with a light-transmitting gas-tight container 2, a filament 3 disposed in the inside of the light-transmitting gas-tight container 2, and a pair of lead wires 4 and 5 electrically connected to the both ends of the filament 3 and supporting the filament 3. The light-transmitting gas-tight container 2 is constituted with, for example, glass or quartz.

A base 9 is put on a sealing part of the light-transmitting gas-tight container 2. The base 9 comprises a side electrode 6, a center electrode 7, and an insulating part 8, which insulates the side electrode 6 and the center electrode 7. One end of the lead wire 4 is electrically connected to the side electrode 6, and one end of the lead wire 5 is electrically connected to the center electrode 7.

The filament 3 composed of a wire material consisting of a single crystal of a metal showing low resistance and high melting point. Specifically, it consists of a single crystal of any one of tungsten, molybdenum, rhenium, osmium, niobium, iridium, lutetium, carbon, tantalum carbide, hafnium carbide, zirconium carbide, tungsten carbide, and tantalum. As described above, the single crystal filament 3 contains no grain boundary or almost no grain boundary. The sum of the concentration of lattice defects and impurity concentration of the single crystal filament 3 is smaller than a predetermined value (for example, smaller than 0.01%). That is, purity of the single crystal filament (purity calculated by regarding lattice defects as a kind of impurities, in addition to common impurities) is 99.99% or higher.

A single crystal of tungsten, molybdenum, rhenium, osmium, niobium, iridium, lutetium, carbon, tantalum carbide, hafnium carbide, zirconium carbide, tungsten carbide, or tantalum in the form of wire can be produced by the FZ (floating zone) method, CZ (Czochralski) method, or the like. Further, a single crystal metal carbide filament can be produced by subjecting a metal to a carburization treatment. By cutting such a single crystal metal or metal carbide in the form of wire in an appropriate length, the filament 3 can be produced. Further, it is also preferable to polish the surface of the filament to increase reflectance thereof.

If a single crystal filament is utilized according the present invention as described above, it contains no or almost no grain boundary, and therefore it shows high strength even when it is heated to a high temperature. Furthermore, infrared light components can be suppressed to increase visible light components. Hereafter, the principle according to which a single crystal filament suppresses infrared light components to increase visible light components will be explained in detail.

The emissivity of the metallic material constituting the filament 3 is represented by the following equation, Emissivity=1−Reflectance, according to the Kirchhoff's law. The reflectance R is represented by using refractive index n of the metallic material, and extinction coefficient K of the metallic material as shown by the equation (1).

[Equation 1]

$$R = \frac{(n_{air} - n)^2 + \kappa^2}{(n_{air} + n)^2 + \kappa^2} \tag{1}$$

In the equation (1), $n_{air}$ is the refractive index of atmosphere, and is considered to be 1 here. The refractive index n and the extinction coefficient K of the metallic material in the equation (1) have relationships with dielectric constant ∈ represented by the following equations (2) and (3).

[Equation 2]

$$n^2 = \frac{1}{2\varepsilon_0}\left[\sqrt{(\varepsilon_{r1})^2 + (\varepsilon_{im})^2} + \varepsilon_{r1}\right] \tag{2}$$

[Equation 3]

$$\kappa^2 = \frac{1}{2\varepsilon_0}\left[\sqrt{(\varepsilon_{r1})^2 + (\varepsilon_{im})^2} - \varepsilon_{r1}\right] \tag{3}$$

In the equations (2) and (3), $\in_0$ is dielectric constant of vacuum (in the atmosphere), and is considered to be 1 here. Further, $\in_{r1}$ and $\in_{im}$ represent the real part and imaginary part of the dielectric constant ∈ of the metallic material, respectively.

The frequency (ω) dependencies of the real part $\in_{r1}$ and the imaginary part $\in_{im}$ of the dielectric constant $\in$ are described by the following equations using the Drude model of metal.

[Equation 4]

$$\varepsilon_{r1} = \varepsilon_0 - \frac{\omega_p^2}{(\omega^2 + \gamma^2)} \tag{4}$$

[Equation 5]

$$\varepsilon_{im} = \frac{\omega_p^2}{(\omega^2 + \gamma^2)} \cdot \frac{\gamma}{\omega} \tag{5}$$

In the equation (4) and (5), $\omega_p$ is plasma frequency of the metallic material, and γ is conduction electron scattering rate. γ can be represented by the following equation (6).

[Equation 6]

$$\gamma = \frac{1}{\tau_{ph}} + \frac{1}{\tau_{im}} \tag{6}$$

In the equation (6), $\tau_{ph}$ is relaxation time of electron scattering by phonon, and $\tau_{im}$ is relaxation time of electron scattering by impurities. These $\tau_{ph}$ and $\tau_{im}$ can be quantitatively evaluated by using the Boltzman-Bloch equation, and can be eventually represented by the following equations (7) and (8).

[Equation 7]

$$\frac{1}{\tau_{ph}} = \frac{m * q_D^4 \cdot E_F^2}{36\pi\kappa\hbar^3 k_F^3 \mathrm{Mc}^2 \cdot n_i} \cdot kT \tag{7}$$

[Equation 8]

$$\frac{1}{\tau_{im}} = \frac{n_i m * k_F \zeta(\theta)}{(2\pi)^2 \hbar^3} \cdot \rho \tag{8}$$

In the equation (7) and (8), c is the speed of light, h is the Planck constant, m* is effective mass of electron, M is mass of metal lattice, $n_1$ is free electron density in metal, $k_F$ is Fermi wave number of metal, $E_F$ is Fermi energy of metal, $q_D$ is Debye wave number of metal, T is temperature, k is the Boltzmann constant, ρ is impurity concentration, and ζ(θ) is Fourier integral of impurity potential for total solid angle range.

From the equations (7) and (8), it can be seen that the relaxation time of electron scattering by phonon $\tau_{ph}$ is inversely proportional to the temperature (kT), and the relaxation time of electron scattering by impurities $\tau_{im}$ is inversely proportional to the impurity concentration ρ. From the temperature dependency of the relaxation time of electron scattering by phonon $\tau_{ph}$ and the impurity concentration dependency of relaxation time of the electron scattering by impurities $\tau_{im}$ represented by the equations (7) and (8), change of reflectance R, in turn, change of emissivity, can be eventually obtained.

By substituting the right sides of the equations (7) and (8) for the corresponding members in the right side of the equation (6), the temperature dependency and impurity concentration dependency of γ can be expressed, and by substituting the right side of the equation (6) obtained by the above substitution and showing the aforementioned dependencies for γ in the equations (4) and (5), temperature dependencies and impurity concentration dependencies of the real part and the imaginary part of dielectric constant can be expressed. By substituting the right sides of the equations (4) and (5) obtained as described above and showing temperature dependencies and impurity concentration dependencies of the real part [equation (4)] and the imaginary part [equation (5)] of the dielectric constant for $\in_{r1}$ and $\in_{im}$ in the equations (2) and (3), temperature dependencies and impurity concentration dependencies of the refractive index and the extinction coefficient can be expressed. By substituting the refractive index and extinction coefficient calculated from the equations (2) and (3) obtained above and representing the temperature dependencies and impurity concentration dependencies thereof for n and K in the equation (1), temperature dependencies and impurity concentration dependencies of the reflectance and the emissivity (=1−reflectance) of metal can be expressed. For the purpose of the present invention, wavelength dependency of the reflectance observed with changing temperature and impurity concentration was determined with a simplification, i.e., with the assumption of $1/\tau_{ph} \approx 1/\tau_{im}$ at room temperature of 300K, without substitution of the values of the aforementioned parameters of metal for the corresponding symbols in the equations (7) and (8), in order to equally determine the temperature dependency and the impurity concentration dependency of the reflectance of the metal, and shown in FIGS. 2 to 4 explained below.

Figure 2A:
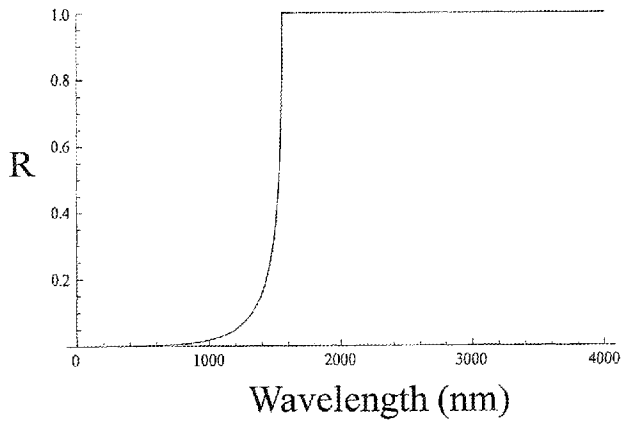
FIGS. 2A to 2D are graphs showing wavelength dependency of reflectance R observed at an impurity concentration $\rho=0$ with changing temperature T.
Figure 2B:
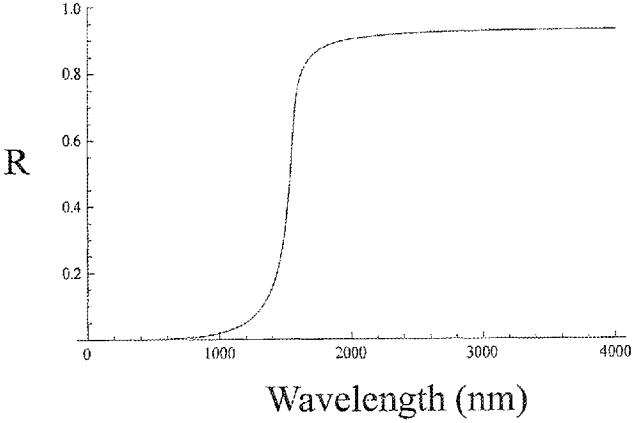
Figure 2C:
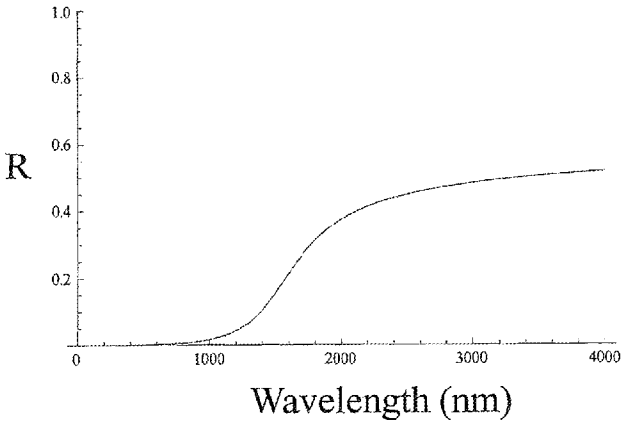
Figure 2D:
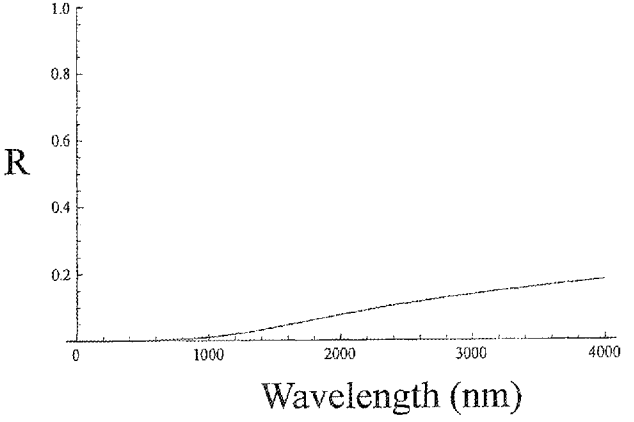
Figure 3A:
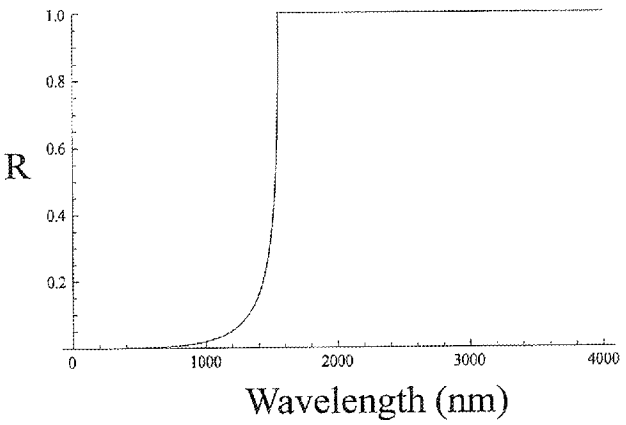
FIGS. 3A to 3D are graphs showing wavelength dependency of reflectance R observed at a temperature T=0K with changing impurity concentration $\rho$.
Figure 3B:
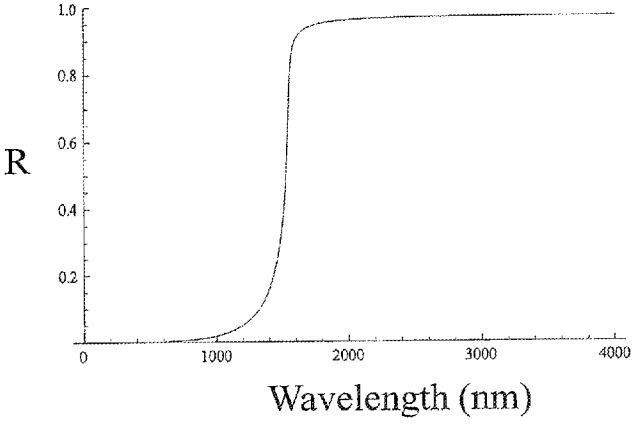
Figure 3C:
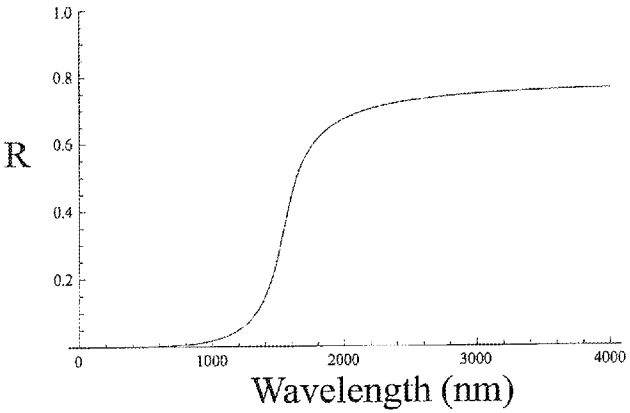
Figure 3D:
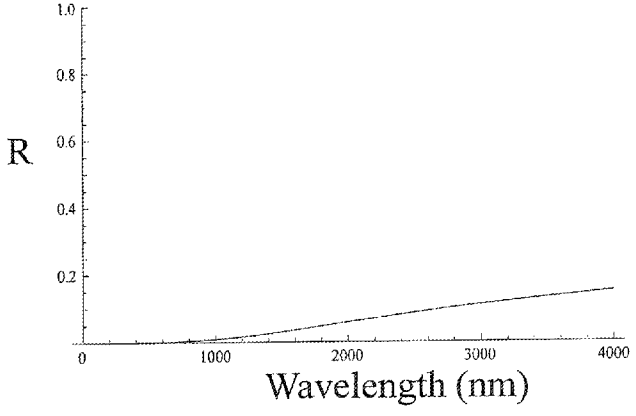

FIGS. 2A to 2D show wavelength dependency of the reflectance R, i.e., change of the reflectance observed with changing the temperature at an impurity concentration of 0, which was obtained on the basis of the equations (7) and (8). For this purpose, the plasma frequency $\omega_p$ of the metallic material was assumed to be 0.8 eV. When the temperature of the metallic material is 0K, the reflectance is 1 with an energy not higher than that of the plasma frequency $\omega_p$ (longer wavelength side) as shown in FIG. 2A, but the reflectance for the longer wavelength side decreases as the temperature of the metallic material becomes higher as shown in FIGS. 2B to 2D. It can be seen that, since the emissivity is represented by the following equation, Emissivity=1−Reflectance, the emissivity for the longer wavelength region (infrared wavelength) becomes higher when the metallic material is heated to a high temperature (namely, radiation control property is degraded), and thus the visible light conversion efficiency decreases when the filament is heated.

FIGS. 3A to 3D show the wavelength dependency of the reflectance (R) observed with maintaining the temperature of the metallic material to be 0K, and changing the impurity concentration. The reflectance for the longer wavelength side decreases as the impurity concentration becomes higher, similarly to the case of elevating the temperature shown in FIGS. 2A to 2D. That is, it is demonstrated that the reflectance shows similar dependency on the temperature and impurities, as shown by the equations (7) and (8).

Figure 4A:
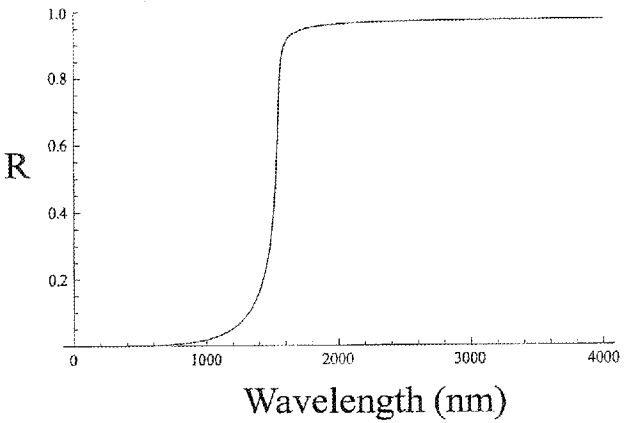
FIGS. 4A to 4D are graphs showing wavelength dependency of reflectance R observed at a temperature T=300K or 3000K and an impurity concentration $\rho=0$ or 0.01.
Figure 4B:
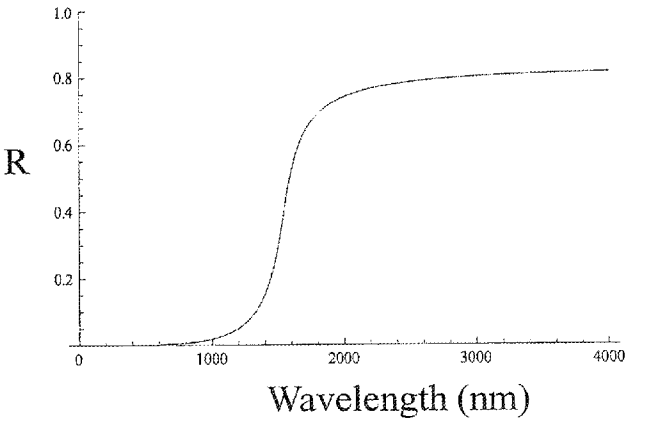
Figure 4C:
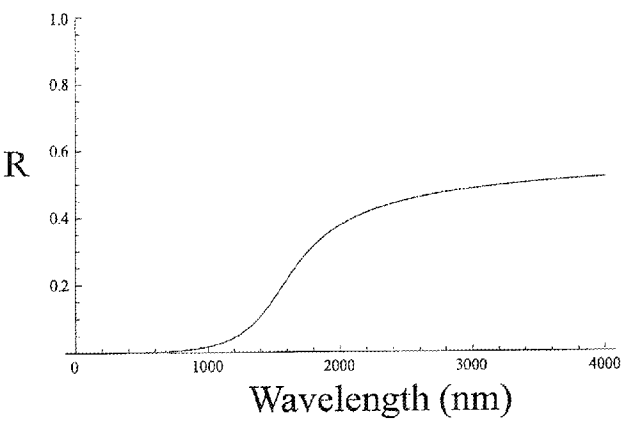
Figure 4D:
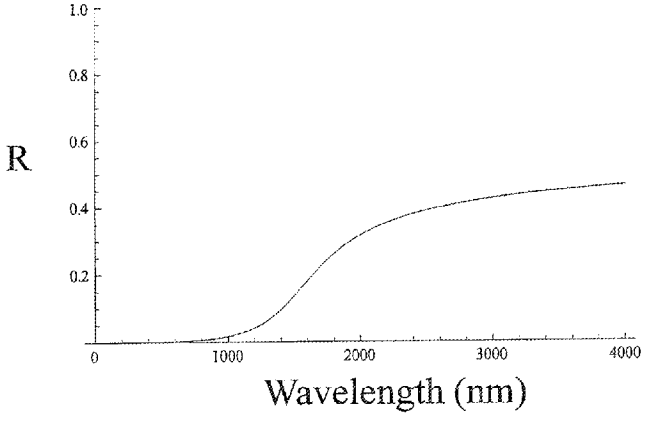

FIGS. 4A to 4D show the wavelength dependency of the reflectance R observed at limited temperatures with the presence or absence of impurities. FIGS. 4A and 4B show the results obtained at a temperature T=300K, FIGS. 4C and 4D show the results obtained at a temperature T=3000K, FIGS. 4A and 4C show the results obtained with an impurity concentration ρ=0, and FIGS. 4B and 4D show the results obtained with an impurity concentration ρ=0.01.

On the basis of comparison of the results shown in FIGS. 4A and 4B, it can be seen that the reflectance R more markedly decreases with the presence of impurities (FIG. 4B) at a low temperature (300K). Since the impurity concentration is the same even when the temperature changes, the effect of lattice scattering (temperature) becomes more marked as the temperature becomes higher, and ratio of the effect of the impurity concentration is reduced. For example, as seen from the comparison of the results shown in FIGS. 4C and 4D, at a high temperature (3000K), the reflectance R for long wavelength (wavelength of 4000 nm) is 0.52 at the impurity concentration $\rho=0$ as shown in FIG. 4C, whereas the reflectance R for long wavelength (wavelength of 4000 nm) is 0.42 at the impurity concentration $\rho=0.01$ as shown in FIG. 4D, and the difference of the reflectance is about 10%. This difference in the reflectance corresponds to a large difference in visible light conversion efficiency of 30%.

By the way, it seems to be also possible to decrease the impurity concentration in a polycrystal filament material having an improved purity. However, as described above, polycrystals suffer from electron scattering due to lattice defects such as grain boundary and dislocation, and they function in the same manner as that of impurities. Therefore, it is necessary to reduce the lattice defects such as grain boundary and dislocation by single crystallization.

Figure 5A:
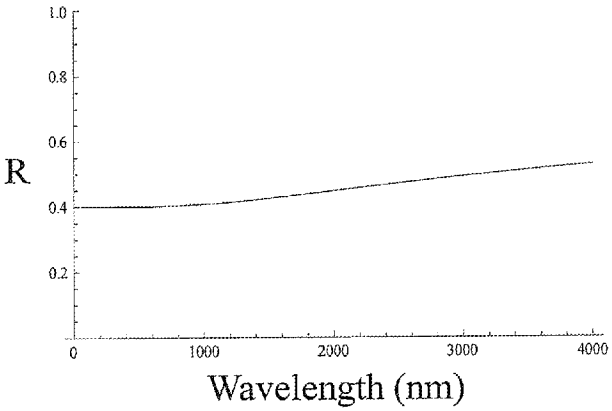
FIGS. 5A to 5C are graphs showing wavelength dependency of reflectance R observed at a temperature T=3000K and an impurity concentration $\rho=1\%$ (0.01), 0.1% (0.001), or 0.01% (0.0001).
Figure 5B:
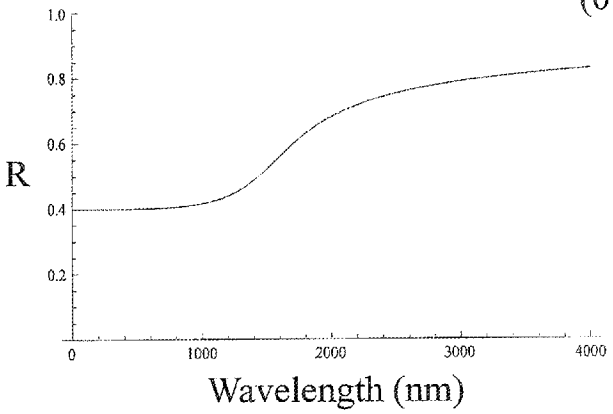

Hereafter, the maximum impurity concentration that provides the effect in an actual single crystal material will be estimated for a specific type of metal by using the equations (7) and (8). The calculation will be performed for tungsten most frequently used as the filament as an example. The plasma frequency $\omega_p$ of tungsten is assumed to be 0.8 eV in order to well express the actual wavelength dependency of the reflectance. The temperature dependency of the rate of scattering by phonon can be expressed as $1/\tau_{ph}=2\times10^{10}$ (Hz)·(K), and the rate of scattering by impurities can be expressed as $1/\tau_{im}=2\times10^{16}$ (Hz)·(atm %). Therefore, in the case of a usual filamentous material of 99% purity containing much impurities, the rate of scattering by phonon is $1/\tau_{ph}=6\times10^{13}$ (Hz), and rate of scattering by impurities is $1/\tau_{im}=2\times10^{14}$ (Hz), at a temperature of 3000K, and thus scattering by impurities is dominant. As a result, the reflectance for infrared wavelength becomes low (specifically, the reflectance is 0.5 for 4000 nm) as shown in FIG. 5A, and the filament is a filament showing bad luminous flux efficiency. Further, in the case of a usual filamentous material of 99.9% purity containing much impurities, similarly, the rate of scattering by phonon is $1/\tau_{ph}=6\times10^{13}$ (Hz), and the rate of scattering by impurities is $1/\tau_{im}=2\times10^{13}$ (Hz), at a temperature of 3000K, and thus substantially the same levels of contribution to the scattering is observed. As shown in FIG. 5B, the reflectance for infrared wavelength becomes high (specifically, the reflectance is 0.8 for 4000 nm), and it is a filament showing more improved luminous flux efficiency. However, unless the reflectance for infrared wavelength becomes 0.9 or higher, the infrared radiation components increase at the time of heating of the filament, and marked improvement of the luminous flux efficiency is not achieved (improvement of 10% or more of luminous flux efficiency).

Figure 5C:
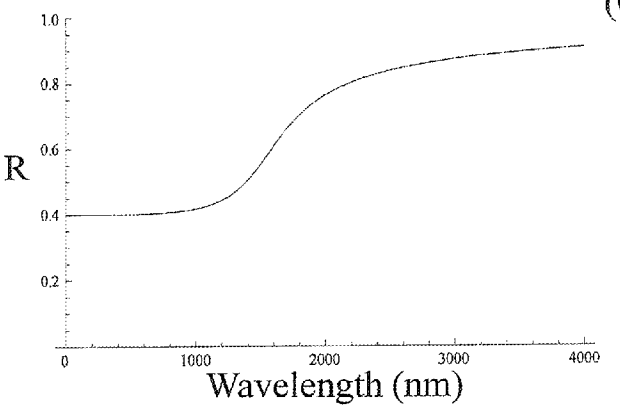
Figure 6:
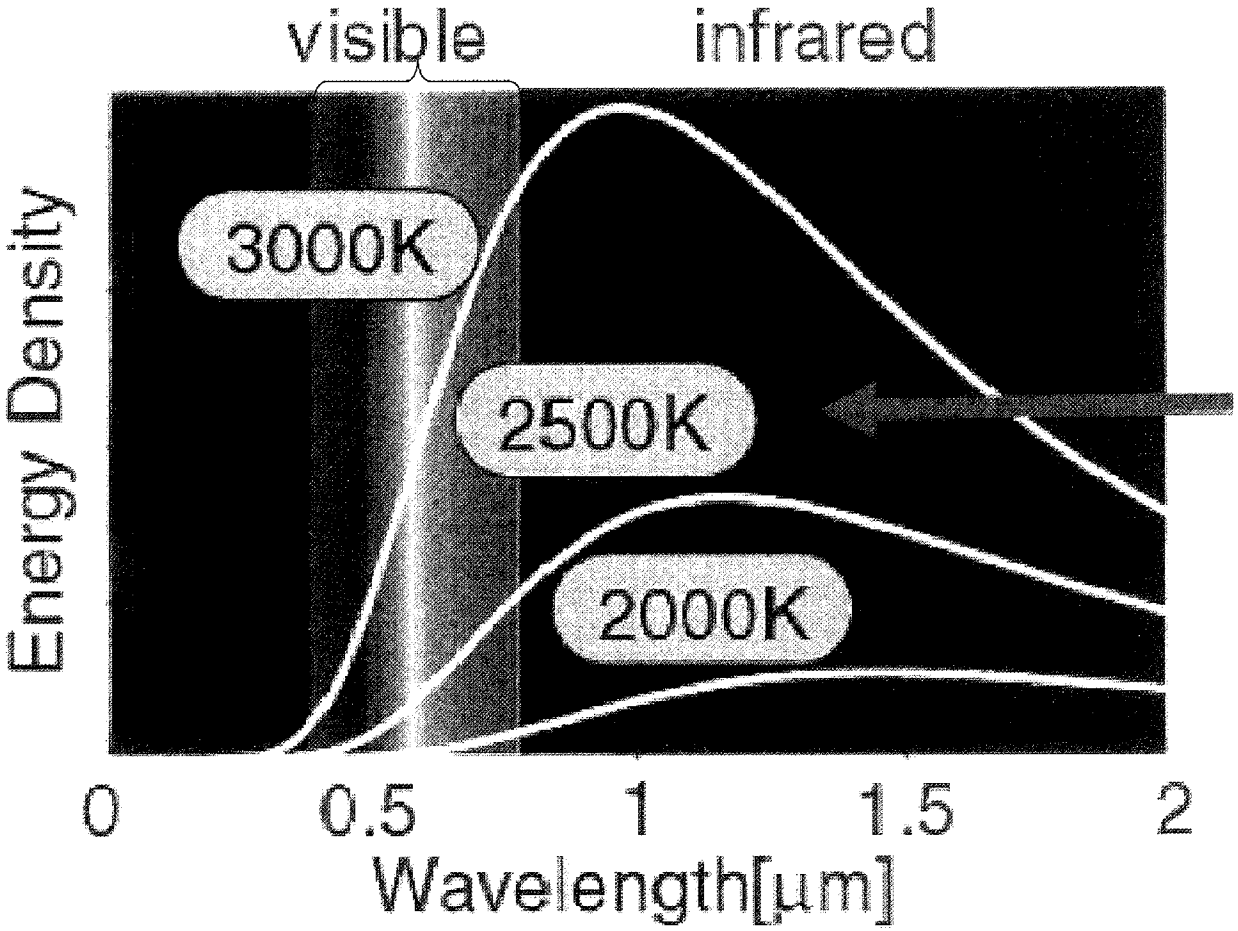
FIG. 6 is a graph showing wavelength dependency of radiation energy of a conventional tungsten filament.

In the case of the exemplary filament material having an improved purity of 99.99%, similarly, the rate of scattering by phonon is $1/\tau_{ph}=6\times10^{13}$ (Hz), and the rate of scattering by impurities is $1/\tau_{im}=2\times10^{12}$ (Hz), at a temperature of 3000K, and thus scattering by phonon is dominant. As shown in FIG. 5C, it can be seen that the exemplary filament material can improve the reflectance for infrared wavelength by 10% or more compared with that of 99.9% purity (specifically, the reflectance is 0.9 for 4000 nm), and there can be produced a filament of which luminous flux efficiency is improved by 30% or more.

The aforementioned effect of impurity concentration shows substantially the same tendency in various high temperature refractory metallic materials, and by using a single crystal filament of 99.99% purity or higher purity as purity calculated by regarding the sum of concentrations of common impurities and lattice defects as impurity concentration, increase of reflectance for the long wavelength side by about 10%, in turn, improvement of visible light conversion efficiency, can be achieved at the time of heating at high temperature, compared with the conventional polycrystal filaments. For example, there can be expected improvements of the visible light conversion efficiency such as:

(a) improvement from 14 lm/W to 18 lm/W in the case of W (2500K),
(b) improvement from 34 lm/W to 58 lm/W in the case of Ta (2500K), and
(c) improvement from 16 lm/W to 22 lm/W in the case of Mo (2500K).

As described above, by using the single crystal filament of the present invention, electric power can be efficiently converted into visible light, and thus a visible light source device (incandescent light bulb) of high efficiency and high luminance can be provided.

Further, since the problems of slippage at crystal grain boundaries and deformation at high temperature observed in the conventional polycrystal filaments can be eliminated by single crystallization, it also becomes possible to provide a filament showing long lifetime and high strength.

The light source device of the present invention such as the light source device of the aforementioned example can be used as various light sources such as light source for illumination, electric bulb for cars, light source for projectors, and light source of backlight for liquid crystal displays.

Further, the filament of the present invention can be used not only for the light source device of the present invention, but also for, for example, electric wires for heaters, electric wires for welding, thermionic electron emission source (X-ray tubes, electron microscopes, etc.), and so forth. Also in such cases, the effect of suppressing radiation of infrared light allows efficient heating of the filament to high temperature with small input power, and therefore the energy efficiency can be improved.

Description of Numerical Notations

1 . . . Incandescent light bulb, 2 . . . light-transmitting gas-tight container, 3 . . . filament, 4 . . . lead wire, 5 . . . lead wire, 6 . . . side electrode, 7 . . . center electrode, 8 . . . sealing part, 9 . . . base.

The invention claimed is:

1. A light source device comprising a light-transmitting gas-tight container, a filament disposed in the light-transmitting gas-tight container, and a lead wire for supplying an electric current to the filament, wherein:

the filament consists of a single crystal; and a sum of concentration of lattice defects and impurity concentration of the filament consisting of a single crystal is lower than 0.01%.

2. A light source device comprising a light-transmitting gas-tight container, a filament disposed in the light-transmitting gas-tight container, and a lead wire for supplying an electric current to the filament, wherein:

the filament consists of a single crystal; and electric specific resistance of the filament consisting of a single crystal is at most 5.5 μΩ·cm.

3. The light source device according to claim 2, wherein the single crystal filament consists of tungsten.

4. The light source device according to claim 2, wherein the electric specific resistance of the filament consisting of a single crystal is at most 1 μΩ·cm.

5. The light source device according to claim 1, wherein the single crystal filament consists of tungsten.

6. The light source device according to claim 1, wherein electric specific resistance of the filament consisting of a single crystal is at most 5.5 μΩ·cm.

7. The light source device according to claim 5, wherein electric specific resistance of the filament consisting of a single crystal is at most 5.5 μΩ·cm.

8. The light source device according to claim 6, wherein the electric specific resistance of the filament consisting of a single crystal is at most 1 μΩ·cm.

9. The light source device according to claim 7, wherein the electric specific resistance of the filament consisting of a single crystal is at most 1 μΩ·cm.

* * * * *